US006199691B1

(12) United States Patent
Wu

(10) Patent No.: US 6,199,691 B1
(45) Date of Patent: Mar. 13, 2001

(54) GOLF CART AND PARTITION RACK ARRANGEMENT

(76) Inventor: David Wu, No. 35-1, Jih Hsin Street, Tu Cheng City, Taipei Hsien (TW)

( * ) Notice: Subject to any disclaimer, the term of this patent is extended or adjusted under 35 U.S.C. 154(b) by 0 days.

(21) Appl. No.: 09/436,262

(22) Filed: Nov. 9, 1999

(51) Int. Cl.[7] ..... A63B 55/00
(52) U.S. Cl. ..... 206/315.6; 206/315.3
(58) Field of Search ..... 206/315.2, 315.3, 206/315.6

(56) References Cited

U.S. PATENT DOCUMENTS 2,551,780 * 5/1951 Wood ..... 206/315.3
5,868,247 * 2/1999 Schrader ..... 206/315.4
6,021,895 * 2/2000 Wu ..... 206/315.6

* cited by examiner

*Primary Examiner*—Sue A. Weaver
(74) *Attorney, Agent, or Firm*—Varndell & Varndell, PLLC

(57) ABSTRACT

A golf bag and partition rack arrangement, which includes a cylindrical bag body having two elastic bands at two opposite sides, a first rack frame and a second rack frame bilaterally fastened to the top cuff of the cylindrical bag shell and coupled to each other through a slip joint, a lever pivoted to the second rack frame and forced by a spring in the second rack frame to hook on one of front and rear locating notches on a locating rod at the first rack frame, and a cap fastened to the second rack frame to limit turning angle of the lever, wherein depressing one end of the lever causes the lever to be disengaged from the locating rod for enabling the second rack to be moved relative to the first rack frame to adjust the pitch between the two rack frames.

2 Claims, 11 Drawing Sheets

GOLF CART AND PARTITION RACK ARRANGEMENT

BACKGROUND AND SUMMARY OF THE INVENTION

The present invention relates to a golf cart, and more specifically to a golf bag and partition rack arrangement in which the partition rack is comprised of two rack frames fastened to the top cuff of the bag shell and coupled to each other by a slip joint, and means to lock the rack frames between two position.

As regular golf bag, as shown in FIG. 1, is comprised of a bag shell, and a partition rack fastened to the inside of the top cuff of the bag shell for keeping golf clubs in good order. However, because the diameter of the top cuff of the bag shell is not adjustable, when golf clubs are loaded, the heads of the golf clubs are put together. It is inconvenient to pick up the golf clubs from the partition rack when the heads of the golf clubs are put together.

According to one aspect of the present invention, the bag shell of the golf bag has two elastic bands at two opposite side wall thereof, which enable the top cuff of the bag shell to be expanded. According to another aspect of the present invention, a first rack frame and a second rack frame are bilaterally fastened to the top cuff of the cylindrical bag shell on the inside and coupled to each other through a slip joint, and a lever is pivoted to the second rack frame and forced by a spring in the second rack frame to hook on one of front and rear locating notches on a locating rod at the first rack frame, and a cap is fastened to the second rack frame to limit turning angle of the lever. Depressing one end of the lever causes the lever to be disengaged from the locating rod for enabling the second rack to be moved relative to the first rack frame to adjust the pitch between the two rack frames.

DETAILED DESCRIPTION OF THE PREFERRED EMBODIMENT

Figure 1:
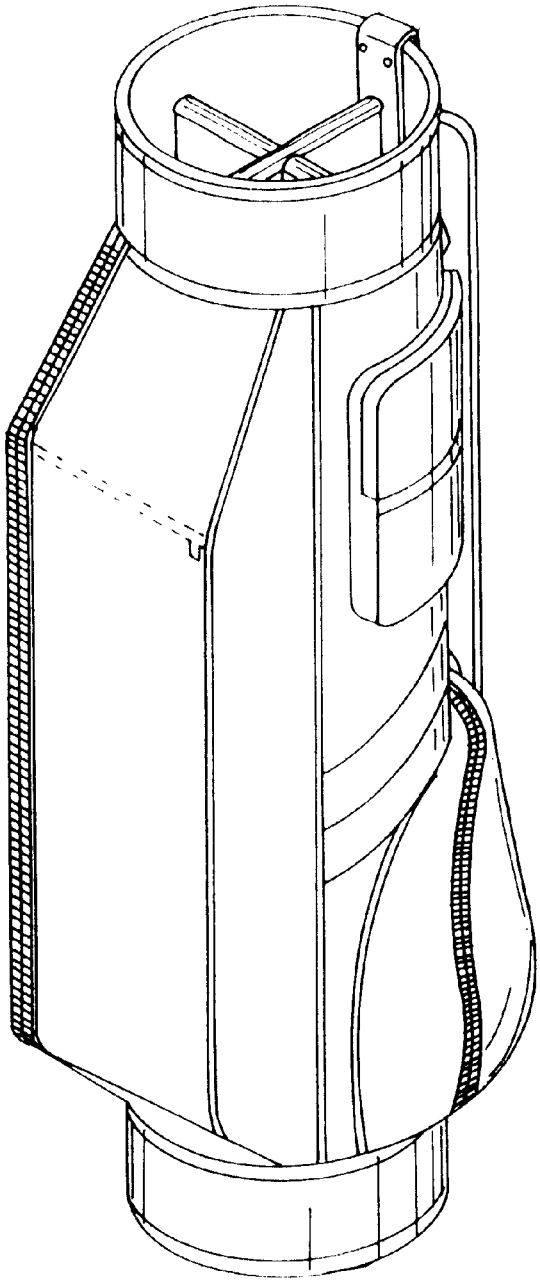
Fig. 1 PRIOR ART
FIG. 1 is a perspective view of a golf bag according to the prior art.

Referring to FIGS. from 2 through 12, the present invention comprises a first rack frame 1, a second rack frame 2, a pivot holder 3, a lever 4, a cap 5, a spring 6, and a bag shell 7.

Figure 2:
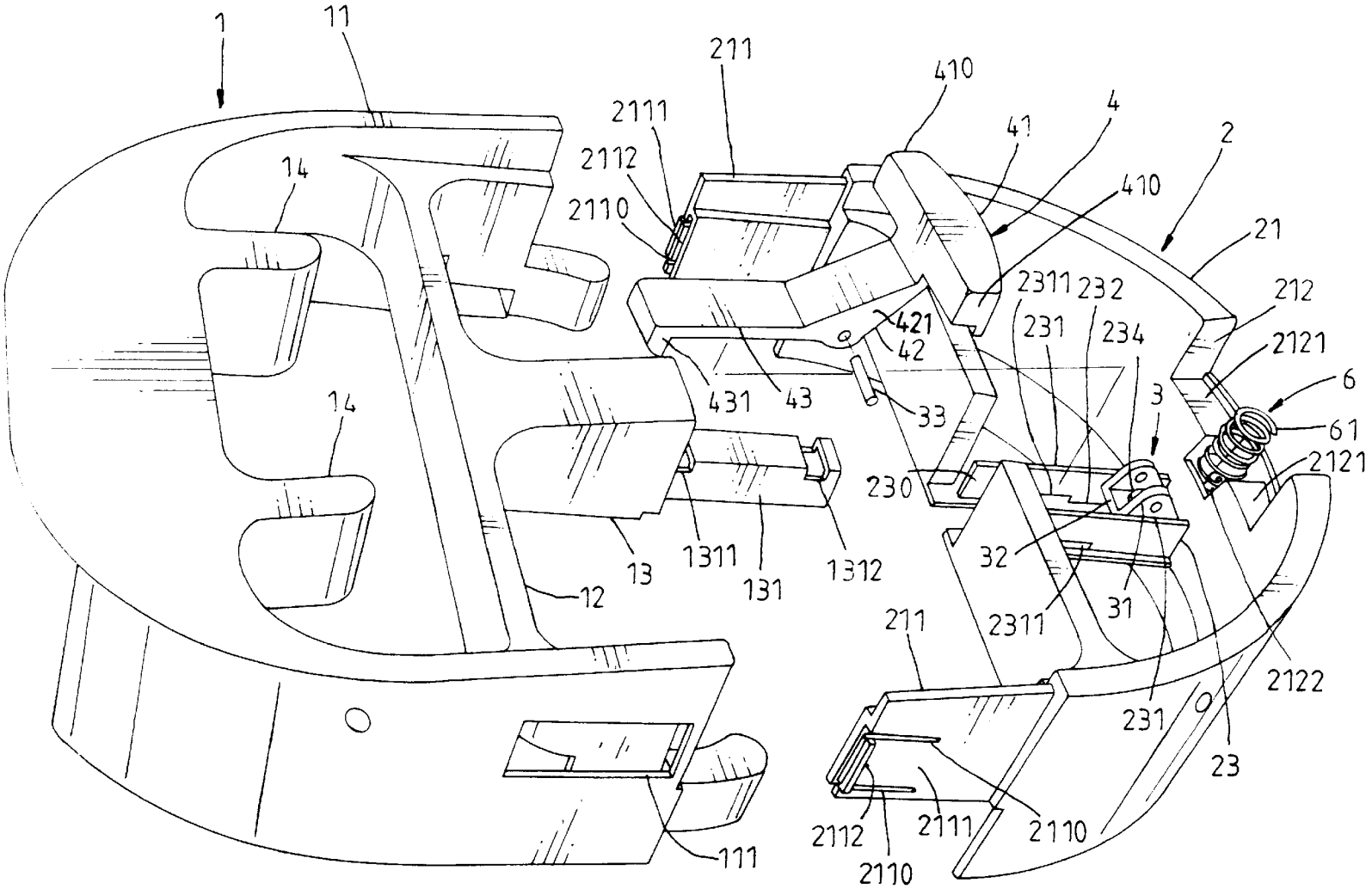
FIG. 2 is an exploded view of the present invention (the bag shell excluded).
Figure 3:
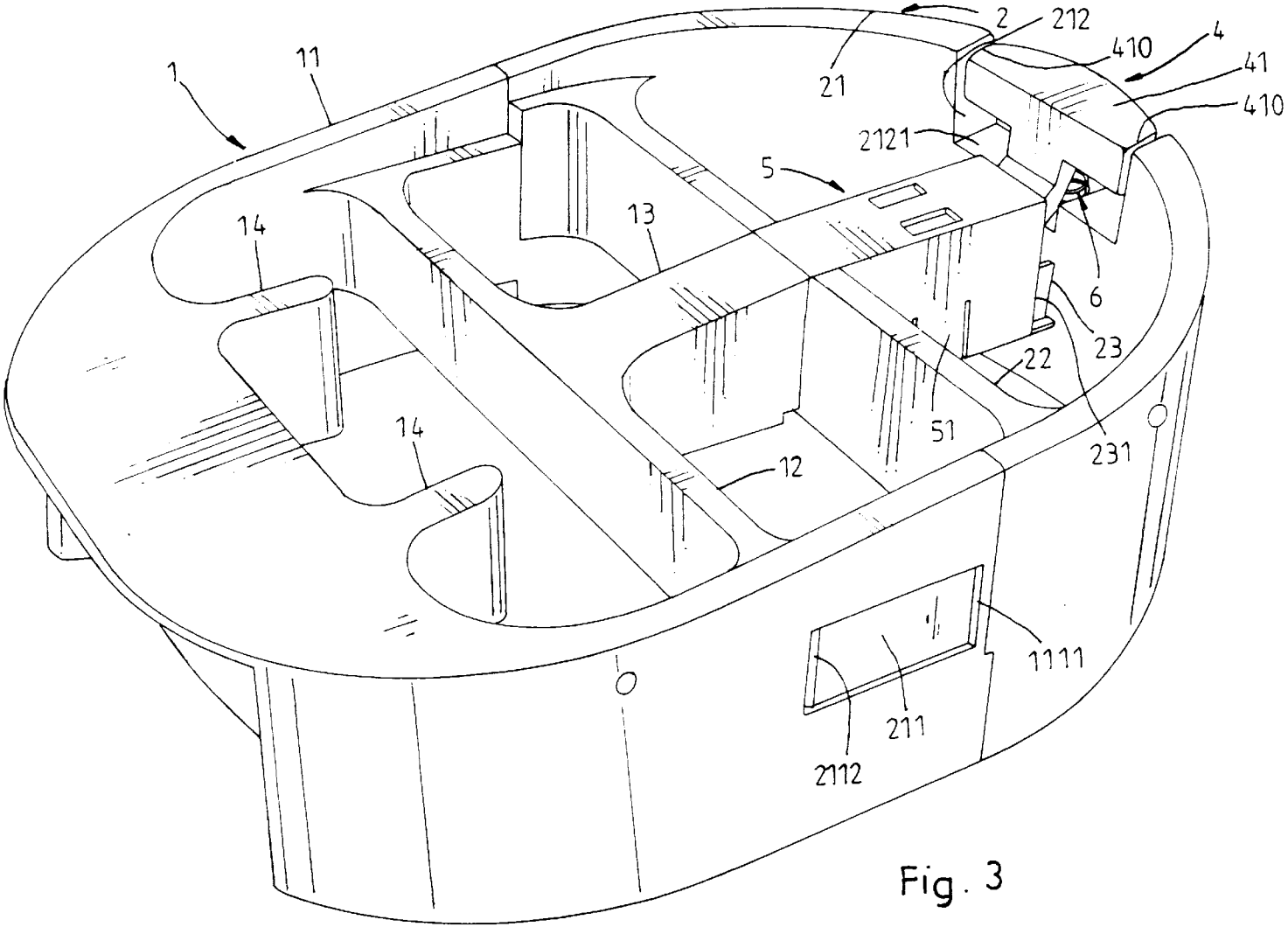
FIG. 3 is an assembly view of FIG. 2.

Referring to FIG. 2 again, the first rack frame 1 comprises an arched peripheral wall 11 fastened to the top end of the bag shell 7, a transverse beam 12 connected between two distal ends of the arched peripheral wall 11, a horizontal support 13 perpendicularly forwardly extended from one side of the transverse beam 12 on the middle, a plurality of partition ribs 14 forwardly extended from the arched peripheral wall 11 at an inner side, a locating rod 131 forwardly extended from the front end of the horizontal support 13, two coupling holes 111 respectively axially formed on two distal ends of the arched peripheral wall 11, and two side locating holes 1111 respectively formed on the two distal ends of the arched peripheral wall 11 at an outer side in communication with the coupling holes 111. The locating rod 131 comprise a rear locating notch 1311, and a front locating notch 1312

Referring to FIGS. 2, 5, 6 and 7 again, the second rack frame 2 comprises an arched peripheral wall 21 fastened to the top end of the bag shell 7, transverse beam 22 connected between two distal ends of the arched peripheral wall 21, a hollow connecting bar 23 connected between the transverse beam 22 and the arched peripheral wall 21, two hollow, box-like coupling flanges 211 respectively forwardly extended from the two distal ends of the arched peripheral wall 21 and respectively inserted into the coupling holes 111 on the two distal ends of the arched peripheral wall 11 of the first rack frame 1, and two hooks 2111 respectively formed integral with the coupling flanges 211 and inserted with the coupling flanges 211 into the coupling holes 111. The hooks 2111 are cut from a respective outer wall at each of the coupling flanges 11, each having a rear end formed integral with the respective outer wall at the coupling flanges 211, two lateral sides spaced from the respective outer wall by gaps 2110, and a front end terminating in an outwardly projected hooked portion 2112. After insertion of the coupling flanges 211 into the coupling holes 111, the hooked portion 2112 of each hook 2111 is respectively forced into the side locating holes 1111 on the arched peripheral wall 11 to limit movement of the second rack frame 2 relative to the first rack frame 1 within a limited range. The hollow connecting bar 23 comprises a horizontal bottom wall 232, two vertical side walls 231 perpendicularly raised from two lateral sides of the horizontal bottom wall 232 and arranged in parallel, a receiving chamber 230 defined between the vertical side walls 231, and two retaining holes 2311 respectively formed on the vertical side walls 231. The receiving chamber 230 extends through the middle part of the transverse beam 22, and receives the locating rod 131 of the first rack frame 1. The arched peripheral wall 21 of the second rack frame 2 comprises an opening 212 on the middle, and a locating rod 2122 in a recessed portion on the middle of the bottom edge 2121 inside the opening 212.

Figure 9:
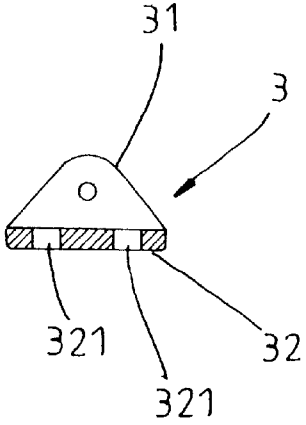
FIG. 9 is a sectional view of the pivot holder according to the present invention.
Figure 13:
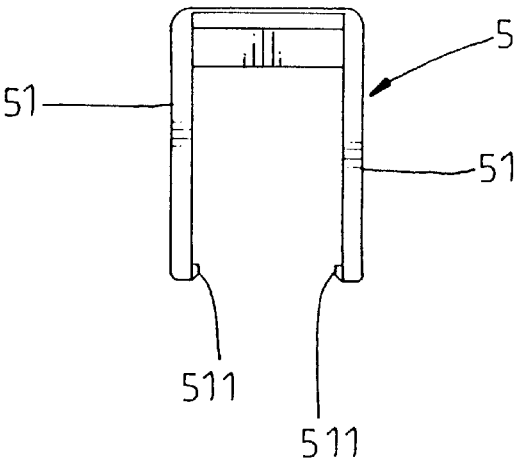
FIG. 13 is an end view of the cap according to the present invention.

Referring to FIGS. 2 and 9 again, the pivot holder 3 comprises a horizontal bottom wall 32 having a plurality of mounting holes 321 respectively fastened to the horizontal bottom wall 232 of the hollow connecting bar 23 by respective fastening elements 234, and two vertical side walls 31 perpendicularly raised from the horizontal bottom wall 32 and arranged in parallel.

Figure 4:
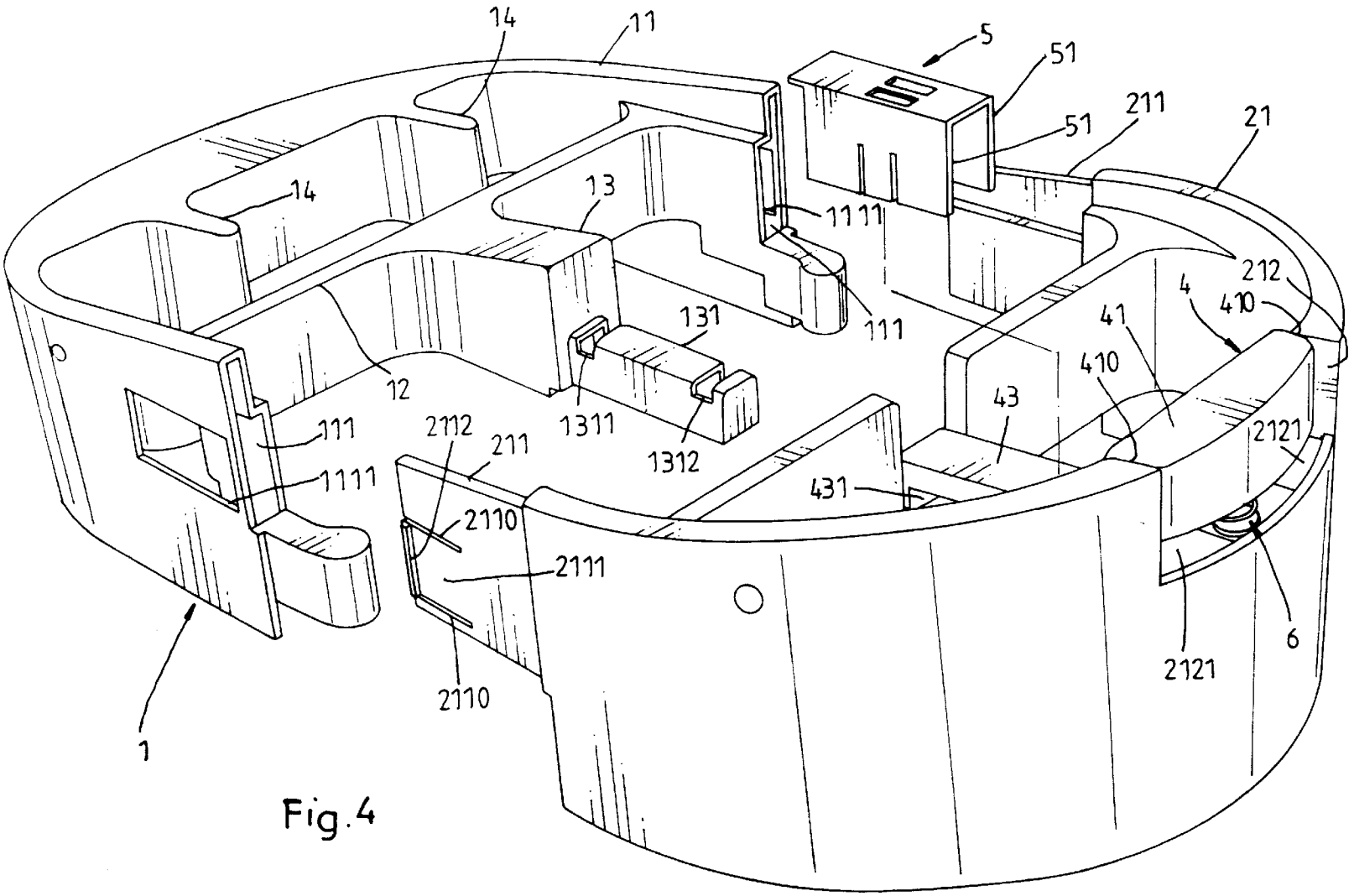
FIG. 4 is another exploded view of the present invention, but showing the lever fastened to the second rack frame.
Figure 5:
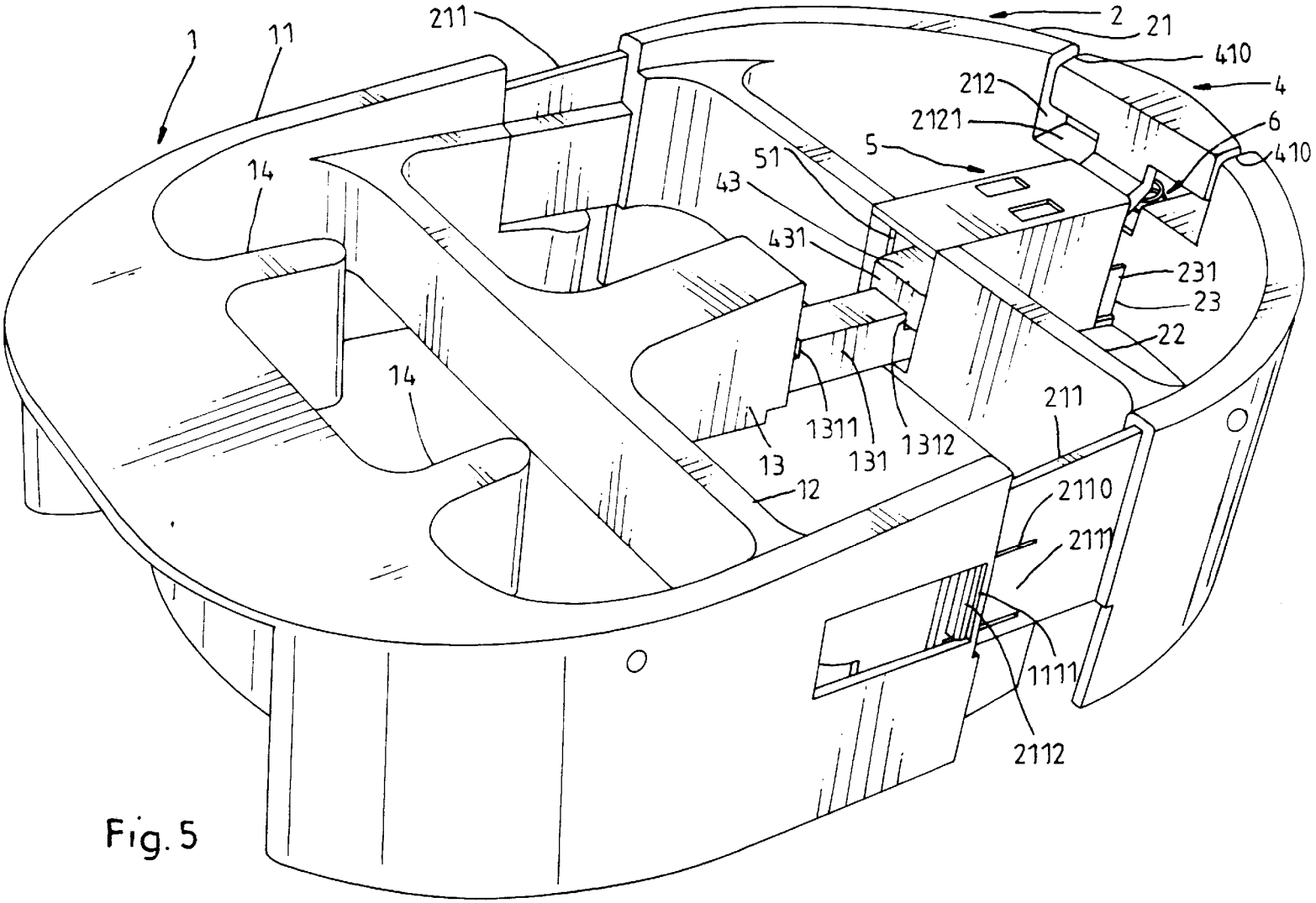
FIG. 5 is another assembly view of FIG. 2, showing the hooked portion of the lever hooked in the front locating notch on the locating rod.
Figure 6:
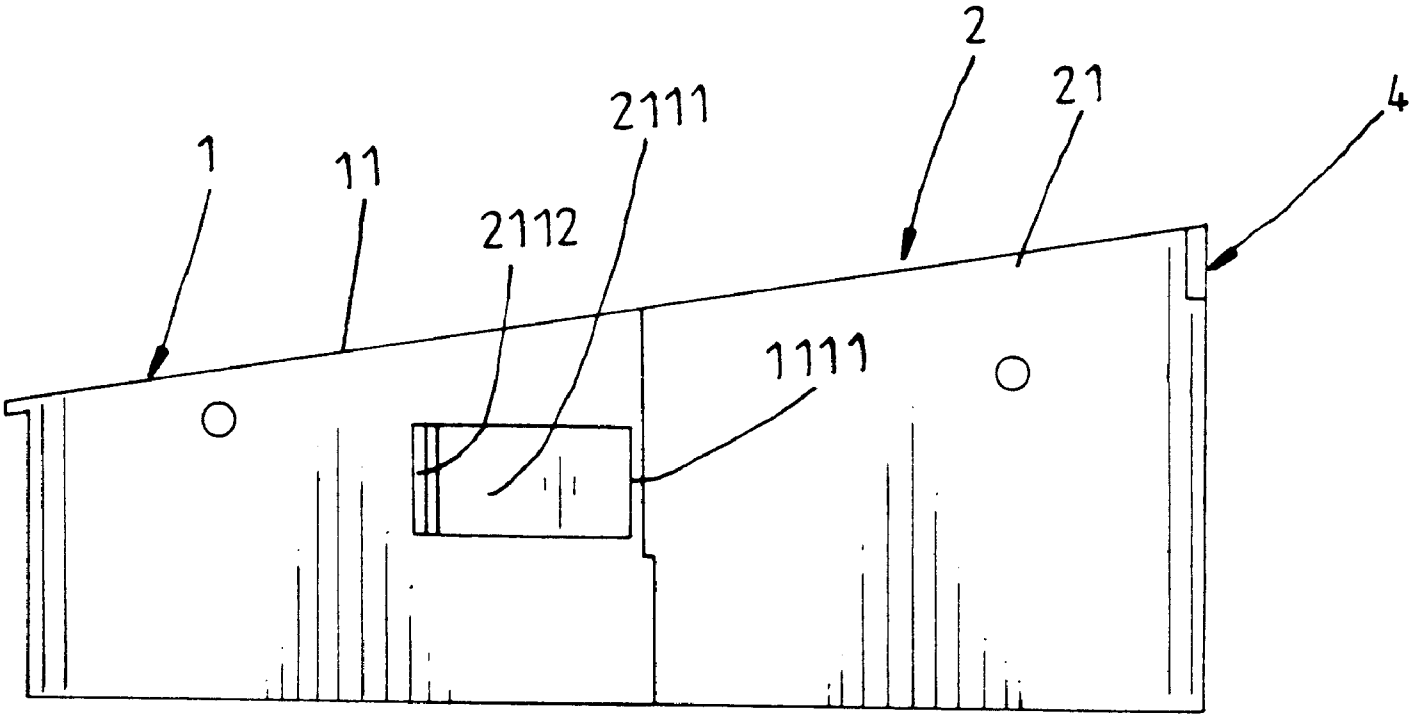
FIG. 6 is a side view of a part of the present invention, showing the first rack and the second rack frame attached together.
Figure 7:
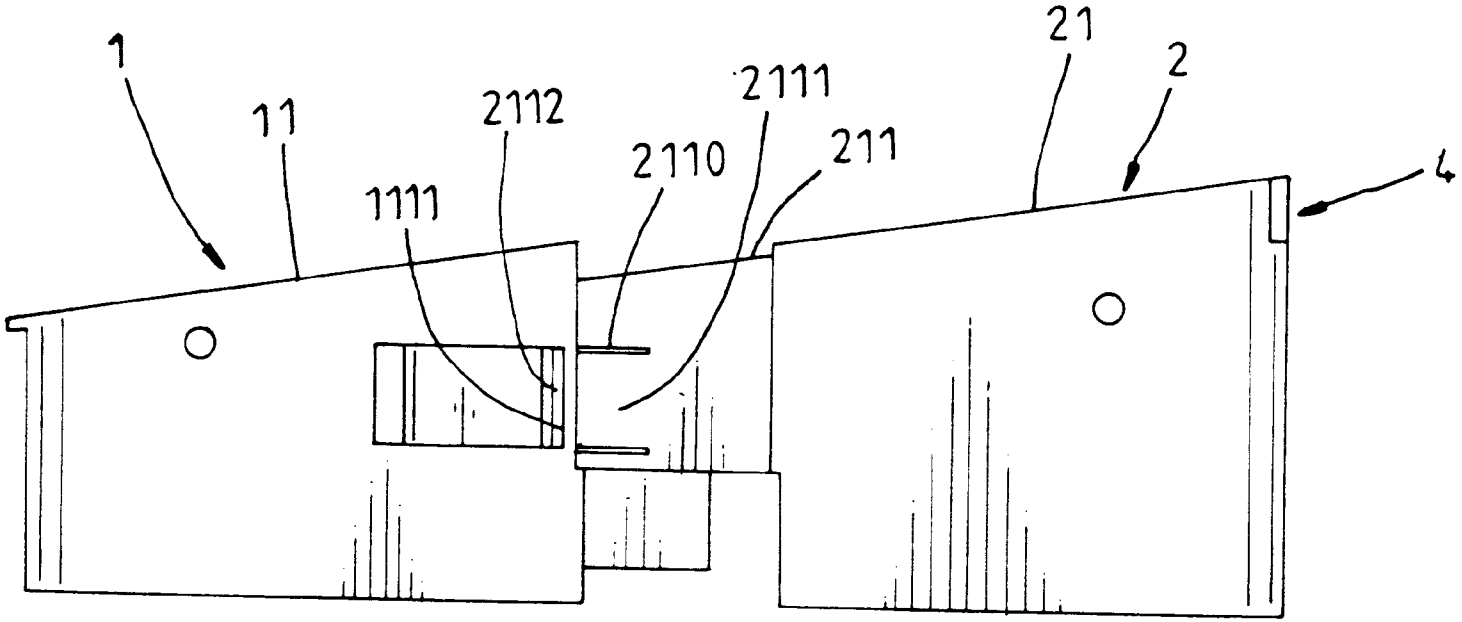
FIG. 7 is similar to FIG. 6 but showing the second rack frame extended out of the first rack frame.
Figure 8:
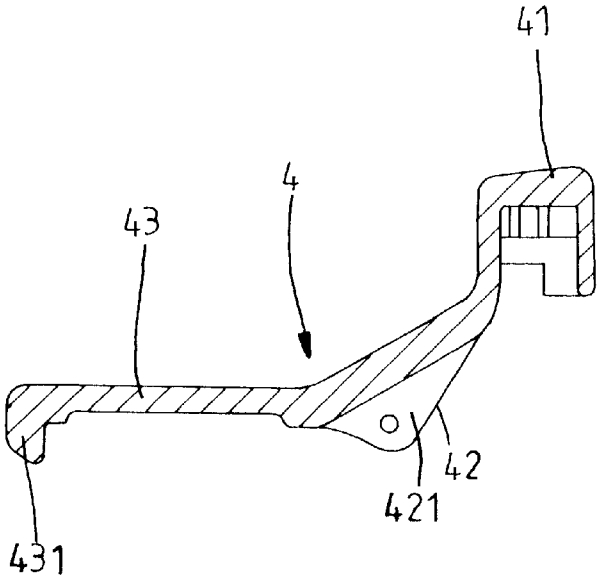
FIG. 8 is a sectional plain view of the lever according to the present invention.

Referring to FIGS. 4, 5 and 8 again, the lever 4 comprises a handle 41 at one end, a front locating strip 43 at an opposite end, and a neck 42 connected between the handle 41 and the locating strip 43. The neck 42 has two parallel side walls 421 pivotally connected between the two vertical sidewalls 31 of the pivot holder 3 by a pivot 33. The front locating strip 43 has a front end terminating in a hook portion 431 for hooking on the front locating notch 1312 or rear locating notch 1311 on the locating rod 131. The handle 41 is supported on the spring 6, having two side winds 410, which are stopped at the bottom edge 2121 in the opening 212 when the handle 41 is pressed down to disengage the hook portion 431 from the front locating notch 1312 or the rear locating notch 1311.

Referring to FIGS. 3, 4, 5 and 13 again, the cap 5 is shaped like a channel bar comprising two parallel sidewalls 51, and two springy hooks 511 formed integral with the sidewalls 51. The cap 5 is mounted on the locating strip 43 of the lever 4, enabling the spring hooks 511 to be respectively hooked in the retaining holes 2311 on the vetical side walls 231 of the connecting bar 23 to secure the lever 4 to the second rack frame 2.

Referring to FIGS. from 2 through 3 again, the spring 6 is fastened to the locating rod 2122 in a recessed portion on the middle of the bottom edge 2121 inside the opening 212 in the arched peripheral wall 21 of the rack frame 2, having a top end 61 protruding over the bottom edge 2121 and stopped at the handle 41 of the lever 4. The spring 6 imparts an upward pressure to the handle 41 of the lever 4, causing the hook portion 431 of the lever 4 to be forced into engagement with the front locating notch 1312 or rear locating notch 1311 on the locating rod 131.

Referring to FIGS. from 10 through 12, the bag shell 7 is a hollow cylindrical shell having a top cuff fastened to the arched peripheral wall 11 of the first rack frame 1 and the arched peripheral wall 21 of the second rack frame 2, and elastic means, for example, two elastic bands 70 provided at two opposite side walls thereof.

Figure 10:
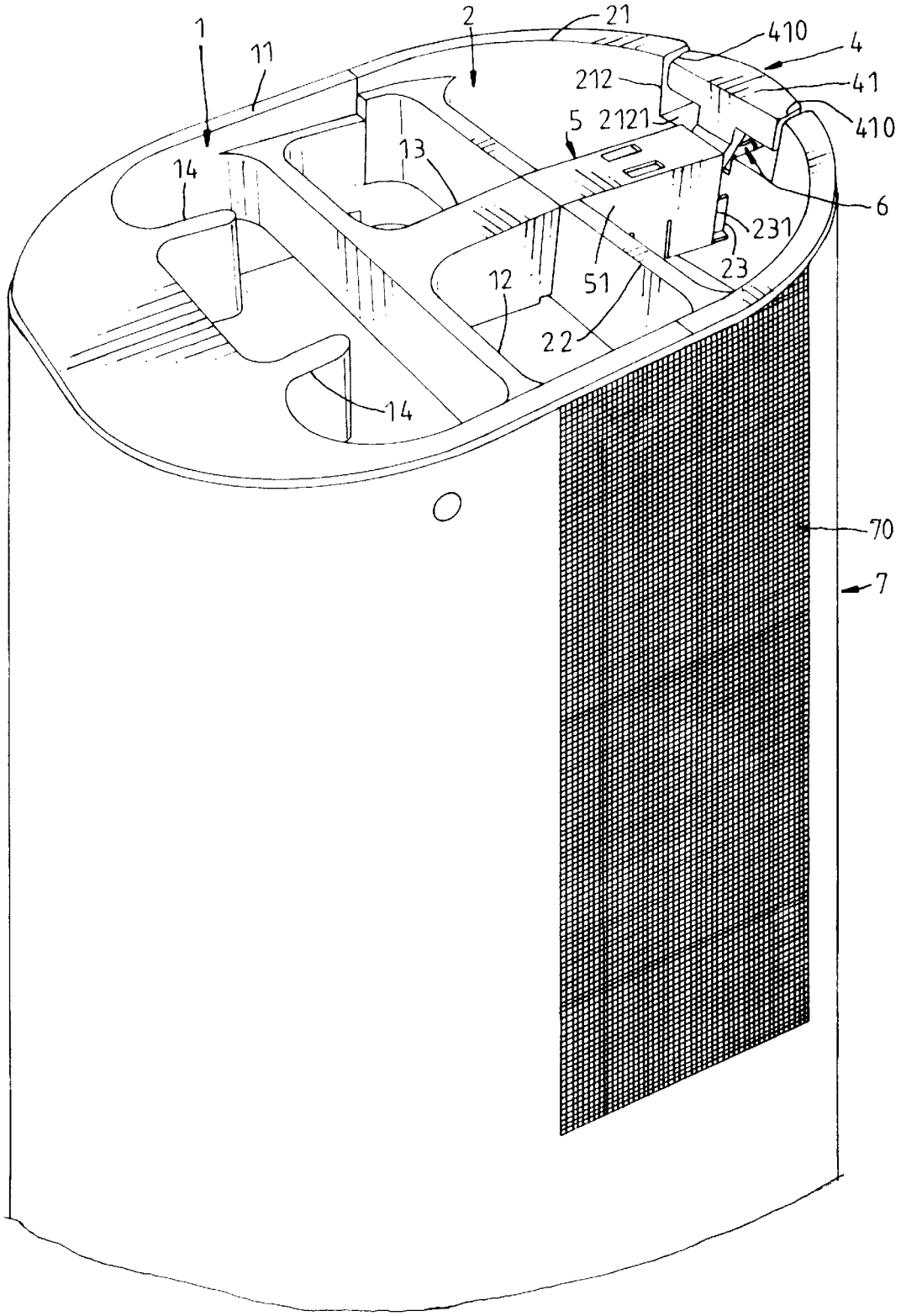
FIG. 10 is a perspective view of the present invention.
Figure 11:
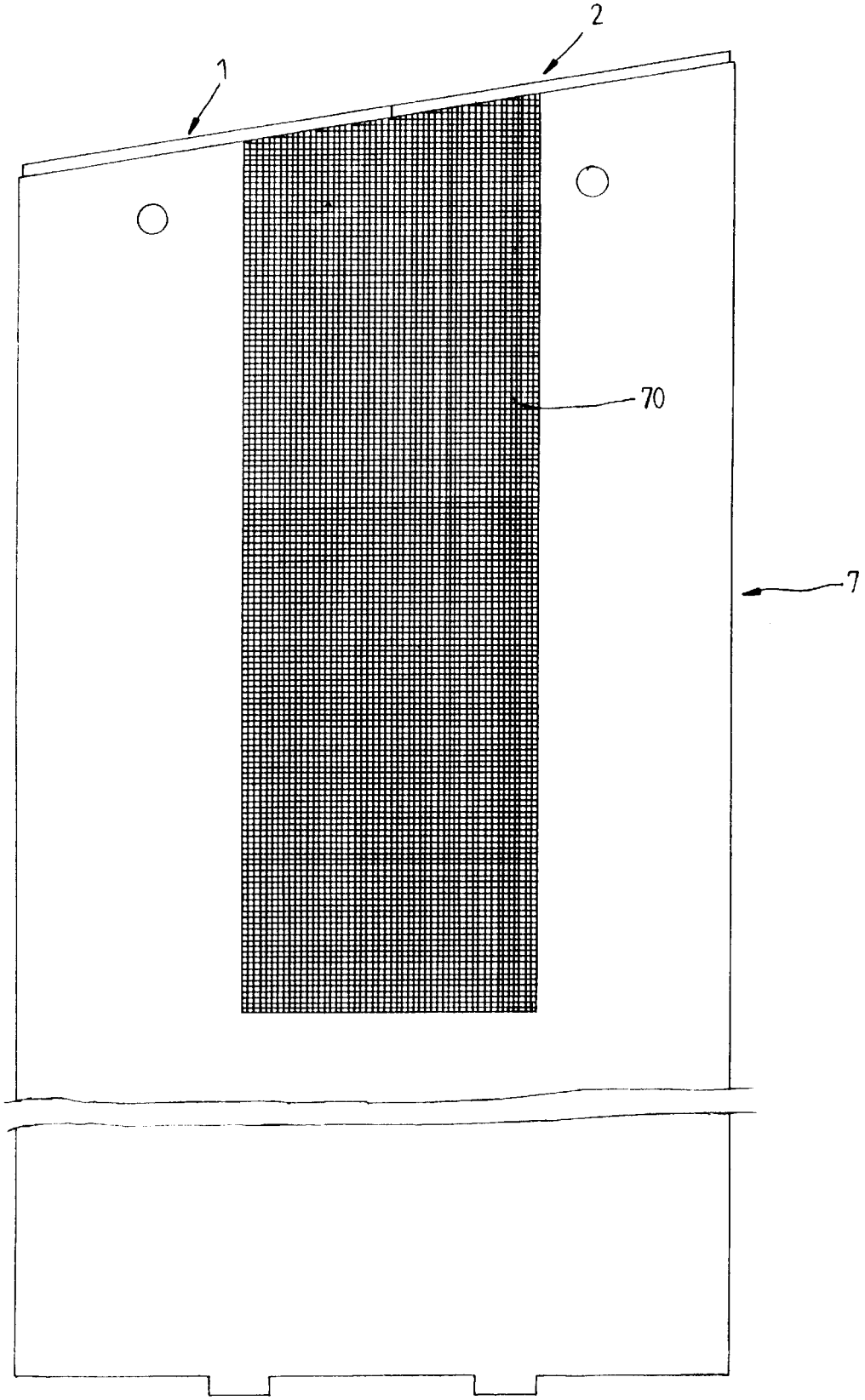
FIG. 11 is a side view of FIG. 10.
Figure 12:
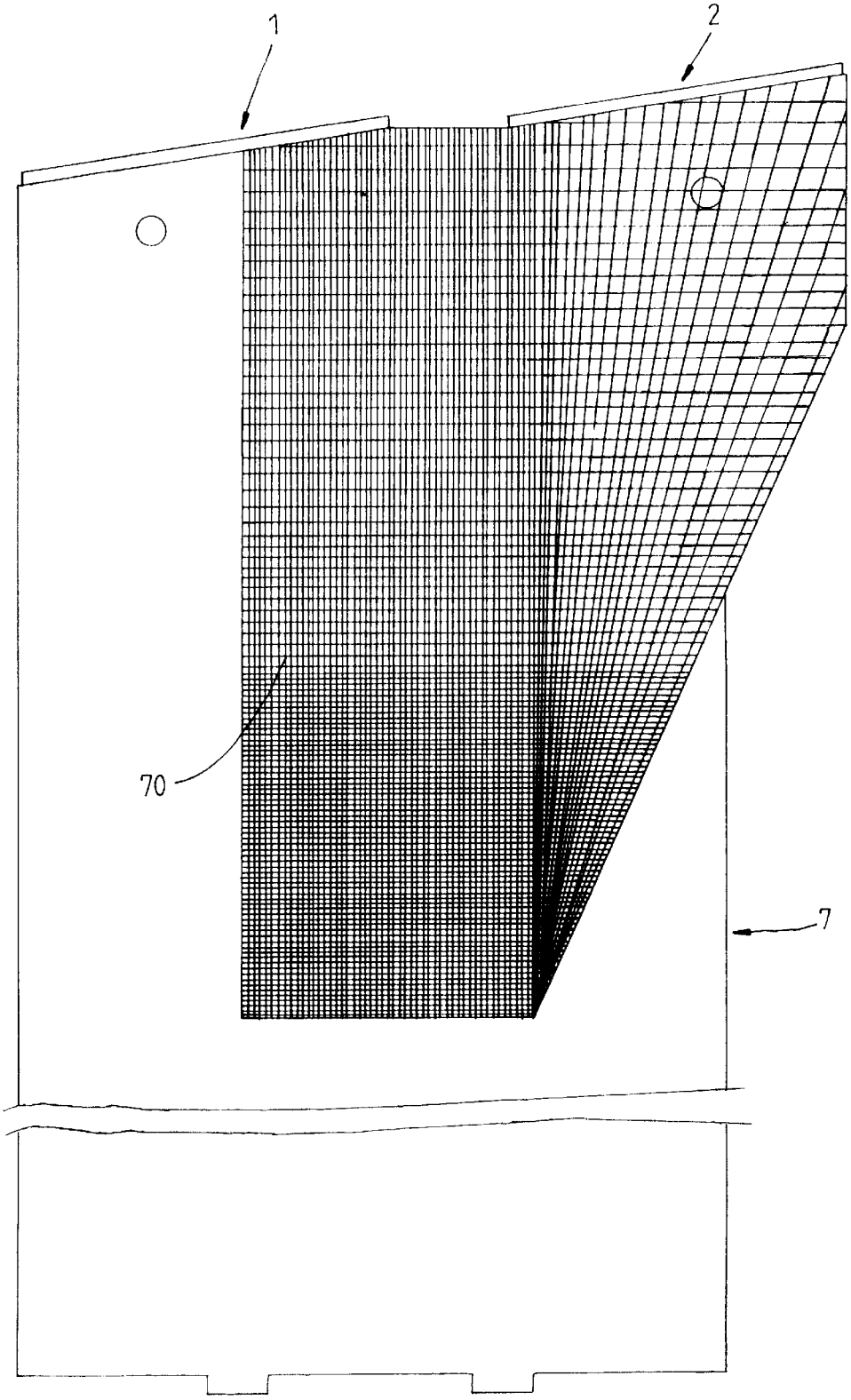
FIG. 12 is another side view of the present invention, showing the second rack frame extended from the first rack frame, the elastic bands of the bag shell expanded.

Referring to FIGS. 3, 5, 10, 11 and 12 again, when the handle 41 of the lever 4 is depressed, the hooked portion 431 is disengaged from the locating rod 131, and can be shifted with the lever 4 between the rear locating notch 1311 and the front locating notch 1312 to hold the partition rack between a first position shown in FIGS. 3 and 10, and a second position shown in FIGS. 5 and 12. When the partition rack is set in the second position, the second rack frame 2 is extended out of the first rack frame 1, the hooked portion 431 of the lever 4 is hooked on the front locating notch 1312, and the elastic bands 70 are expanded, and the space defined within the top cuff of the bag shell 7 is relatively increased.

As indicated above, simply by depressing the handle 41 of the lever 4 to disengage the hooked portion 431 of the lever 4 from the locating rod 131, the second rack frame 2 is allowed to be moved relative to the first rack frame 1 to adjust the pitch between the first rack frame 1 and the second rack frame 2. By shifting the hooked portion 431 of the lever 4 between the front locating notch 1312 and the rear locating notch 1311 to adjust the pitch between the first rack frame 1 and the second rack frame 2, the top opening defined within the top cuff of the bag shell 7 is relatively adjusted.

What is claimed is:

1. A golf bag and partition rack arrangement comprising:

a bag shell, said bag shell comprising two elastic bands at two opposite sides thereof for enabling a top cuff thereof to be expanded;

a first rack frame, said first rack frame comprising an arched peripheral wall fixedly fastened to the inside of the top cuff of said bag shell at one side, a transverse beam connected between two distal ends of the arched peripheral wall of said first rack frame, a horizontal support perpendicularly forwardly extended from one side of the transverse beam of said first rack frame on the middle, a plurality of partition ribs forwardly extended from the arched peripheral wall of said first rack frame at an inner side, a locating rod forwardly extended from said horizontal support, two coupling holes respectively axially formed on the two distal ends of the arched peripheral wall of said first rack frame, and two side locating holes respectively formed on the two distal ends of the arched peripheral wall of said first rack frame at an outer side in communication with the coupling holes on the arched peripheral wall of said first rack frame, said locating rod comprising a rear locating notch, and a front locating notch;

a second rack frame, said second rack frame comprising an arched peripheral wall fixedly fastened to the inside of the top cuff of said bag shell at one side opposite to said first rack frame, a transverse beam connected between two distal ends of the arched peripheral wall of said second rack frame, a hollow connecting bar connected between the transverse beam and arched peripheral wall of said second rack frame, two hollow box-like coupling flanges respectively forwardly extended from the two distal ends of the arched peripehral wall of said second rack frame and respectively inserted into the coupling holes on the two distal ends of the arched peripheral wall of said first rack frame, and two hooks respectively formed integral with said coupling flanges and inserted with said coupling flanges into the coupling holes on the arched peripheral wall of said first rack frame, the hooks of said second rack frame each having an outwardly projected hooked portion respectively projecting into the side locating holes on the arched peripheral wall of said first rack frame to limit movement of said second rack frame relative to said first rack frame within a limited range, said hollow connecting bar comprising a horizontal bottom wall, two vertical side walls perpendicularly raised from two lateral sides of the horizontal bottom wall of said hollow connecting bar and arranged in parallel, a receiving chamber defined between the vertical side walls of said hollow connecting bar and through the middle part of the transverse beam of said second rack frame for receiving the locating rod of said first rack frame, two retaining holes respectively formed on the vertical side walls of said hollow connecting bar, and an opening on the arched peripheral wall of said second rack frame on the middle, and a recessed portion in said opening at a bottom side;

a pivot holder fastened to said hollow connecting bar, said pivot holder comprising a horizontal bottom wall fastened to the horizontal bottom wall of said hollow connecting bar, two vertical side walls perpendicularly raised from the horizontal bottom wall of said pivot holder and arranged in parallel;

a lever pivoted to said pivot holder to secure said first rack frame and said second rack frame together, said lever comprising a handle at one end, a front locating strip at an opposite end, and a neck connected between said handle and said locating strip, said neck having two parallel side walls pivotably connected between the two vertical side walls of said pivot holder by a pivot, said front locating strip having a front end terminating in a hook portion for hooking on one of the front locating notch and rear locating notch on said locating rod to secure said second rack frame to said first rack frame handle;

a cap shaped like a channel bar mounted on the locating strip of said lever and the hollow connecting bar of said second rack frame to secure said lever to said hollow connecting bar, said cap comprising two spring hooks respectively formed integral with two opposite side walls thereof and respectively hooked in the retaining holes on the vertical side walls of said connecting bar; and a spring fastened to the recessed portion in the opening in the arched peripheral wall of said second rack frame to support the handle of said lever and to force said lever into engagement with said locating rod; and wherein depressing the handle of said lever causes the hooked portion of said lever to be disengaged from said locating rod for enabling said second rack frame to be moved relative to said first rack frame, so that the hooked portion of said lever can be shifted between the rear locating notch and front lcoating notch on said locating rod.

2. The golf bag and partition rack arrangement of claim 1 wherein second rack frame comprises a locating rod disposed in the recessed portion in the opening on the arched peripheral wall of said second rack frame to hold said spring in place.

* * * * *